US009335681B2

(12) United States Patent
Ueno

(10) Patent No.: US 9,335,681 B2
(45) Date of Patent: May 10, 2016

(54) IMAGE FORMING APPARATUS WITH CONTROLLER FOR SETTING FIXING TEMPERATURE BASED ON NUMBER OF TIMES OF SHEET REUSE

(71) Applicants: KABUSHIKI KAISHA TOSHIBA, Tokyo (JP); TOSHIBA TEC KABUSHIKI KAISHA, Tokyo (JP)

(72) Inventor: Toshiyuki Ueno, Suntougun Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/714,009

(22) Filed: May 15, 2015

(65) Prior Publication Data

US 2015/0338800 A1 Nov. 26, 2015

(30) Foreign Application Priority Data

May 22, 2014 (JP) ..... 2014-105891

(51) Int. Cl.
*G03G 15/20* (2006.01)
*G03G 21/00* (2006.01)

(52) U.S. Cl.
CPC ..... *G03G 15/2039* (2013.01); *G03G 2215/209* (2013.01)

(58) Field of Classification Search
CPC ..... G03G 15/2039; G03G 15/6585; G03G 21/00; G03G 2215/209
USPC ..... 399/69, 1, 45, 341; 347/179
See application file for complete search history.

(56) References Cited

U.S. PATENT DOCUMENTS

2013/0058666 A1* 3/2013 Takahashi ..... G03G 21/00 399/38
2013/0272729 A1* 10/2013 Kato ..... G03G 15/2039 399/38
2014/0105627 A1 4/2014 Fujiwara
2014/0212160 A1* 7/2014 Fukaya ..... G03G 15/205 399/69

* cited by examiner

*Primary Examiner* — Sophia S Chen
(74) *Attorney, Agent, or Firm* — Patterson & Sheridan, LLP

(57) ABSTRACT

According to an embodiment, an image forming apparatus includes a sensor and a controller. The sensor obtains information regarding reuse of a sheet. The controller controls a heating temperature of a fixer such that a target fixing temperature becomes a fixing temperature corresponding to the information regarding the reuse to be obtained by the sensor.

6 Claims, 8 Drawing Sheets

551

| NUMBER OF TIMES OF REUSE | FIXING TEMPERATURE |
|---|---|
| 0 | 96 DEGREE |
| 1 | 95 DEGREE |
| 2 | 94 DEGREE |
| : | : |
| 7 | 90 DEGREE |

Fig.4

552

| RANGE OF NUMBER OF TIMES OF REUSE | FIXING TEMPERATURE |
|---|---|
| 0~1 | 95℃ |
| 2~3 | 93℃ |
| ⋮ | ⋮ |
| 6~7 | 90℃ |

Fig.7

IMAGE FORMING APPARATUS WITH CONTROLLER FOR SETTING FIXING TEMPERATURE BASED ON NUMBER OF TIMES OF SHEET REUSE

CROSS-REFERENCE TO RELATED APPLICATION

This application is based upon and claims the benefit of priority from the prior Japanese Patent Application No. 2014-105891, filed on May 22, 2014, the entire contents of which are incorporated herein by reference.

FIELD

An embodiment to be described herein generally relates to an image forming apparatus.

BACKGROUND

An image erasing apparatus has been known in which an image printed on a sheet is erased. The image erasing apparatus erases the image printed on the sheet by decolorizing the image. The image erasing apparatus performs the decolorizing process by, for example, applying heat with respect to a toner forming the image. The image erasing apparatus includes a decolorizing unit and a reading unit. The decolorizing unit applies heat to the sheet to decolorize the image printed on the sheet. The reading unit reads the image so as to store the image before the decolorizing process. The reading unit further reads the image again so as to determine whether or not the decolorizing process is normally performed, after the decolorizing process. Meanwhile, an image forming apparatus has been known in which an image is printed on a sheet using a color erasable toner. The above-described image erasing apparatus may decolorize the image printed on the sheet using the color erasable toner by the image forming apparatus. In addition, the image forming apparatus may print an image onto a reused sheet in which the decolorizing process is performed by the above-described image erasing apparatus.

The above-described image forming apparatus fixes an image of a toner onto the sheet at a predetermined fixing temperature at a first-time printing. The image forming apparatus fixes the toner image onto the sheet at the same fixing temperature even at a multiple-time printing. Here, the first-time printing refers to a case in which an image is printed to a new sheet in which the above-described decolorizing process is not performed, for example. The multiple-time printing refers to a case in which an image is printed to the reused sheet in which the decolorizing process is performed multiple times. In addition, a colorless toner is left on the sheet in which the decolorizing process is performed. Accordingly, a fact that printing is performed multiple times means that the toner is superimposed with respect to the sheet. Thus, when the printing and the decolorizing process are repeatedly performed with respect to the same sheet, physical or chemical properties of the sheet are changed.

BRIEF DESCRIPTION OF THE DRAWINGS

FIG. 4 is a diagram illustrating a configuration file of a fixing temperature of the image forming apparatus according to the first embodiment;

FIG. 7 is a diagram illustrating a configuration file of a fixing temperature of an image forming apparatus according to a second embodiment.

DETAILED DESCRIPTION

Figure 1:
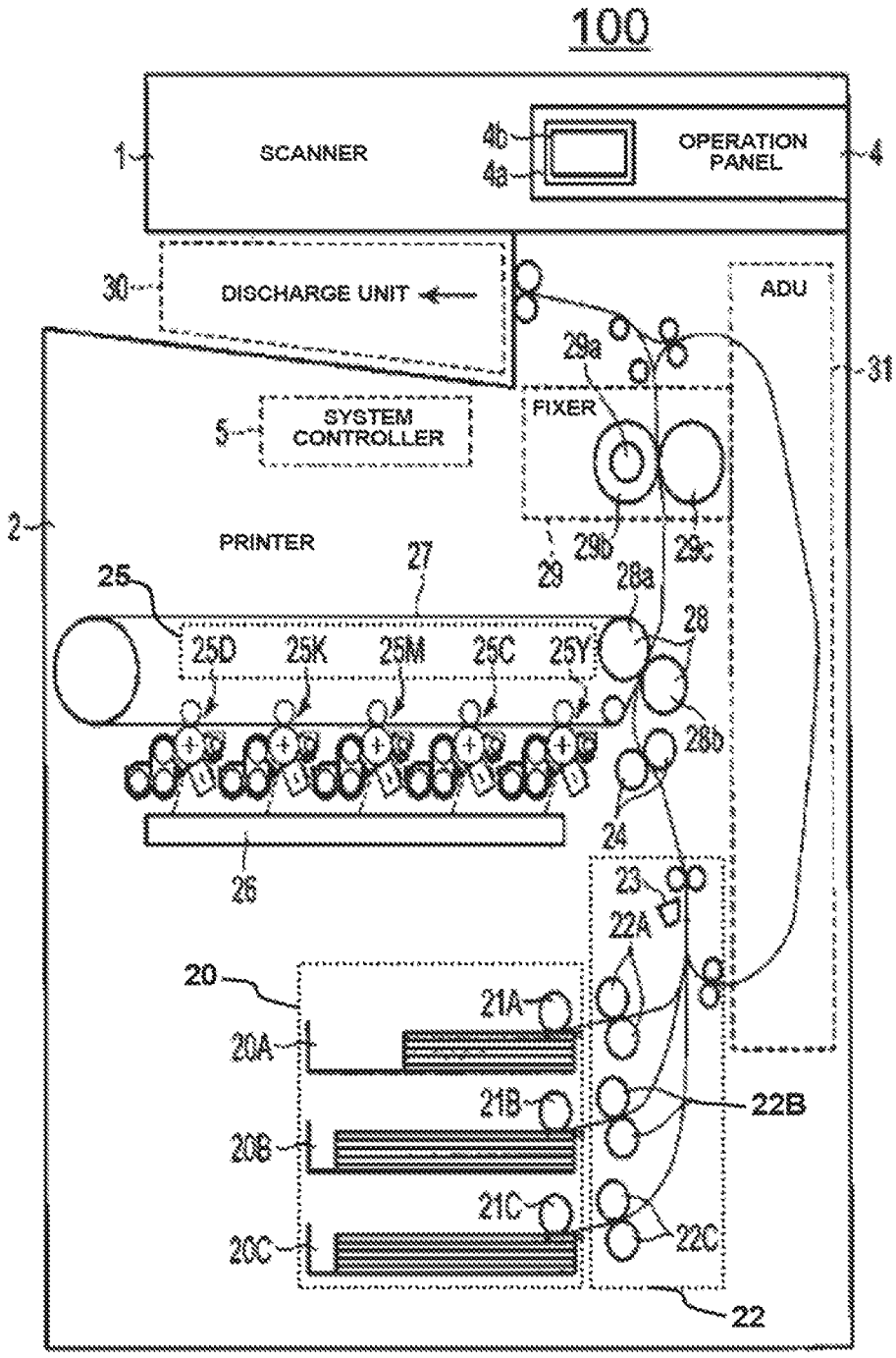
FIG. 1 is a cross-sectional view schematically illustrating an image forming apparatus according to a first embodiment.

According to an embodiment, an image forming apparatus includes a conveying unit, an image forming unit, a fixer, a sensor, and a controller. The conveying unit conveys a sheet. The image forming unit forms an image on the sheet to be conveyed by the conveying unit using an erasable toner. The fixer heats the image at a target fixing temperature so as to fix the image to be formed by the image forming unit onto the sheet. The sensor obtains information regarding reuse of the sheet. The controller controls a heating temperature of the fixer such that the target fixing temperature becomes a fixing temperature corresponding to the information regarding the reuse to be obtained by the sensor.

Hereinafter, a description will be made further regarding embodiments with reference to the drawings. In the drawings, the same reference numeral denotes the same or similar part. An image forming apparatus according to the embodiment will be described exemplifying a multi-Function peripherals (MFP).

An MFP according to a first embodiment will be described with reference to FIGS. 1 to 6. FIG. 1 is a cross-sectional view schematically illustrating a configuration of an MFP 100 according to the first embodiment. As illustrated in FIG. 1, the MFP 100 includes a scanner 1, a printer 2, an operation panel 4 and a system controller 5.

The scanner 1 is an apparatus which reads a document image and convert it into image data. The scanner 1 includes a well-known configuration such as a charge-coupled device (CCD) line sensor so as to convert the document image into the image data. The scanner 1 may be an apparatus which reads the document image by scanning the document placed on a document table glass (not illustrated). The scanner 1 may be an apparatus which reads the document image to be conveyed by an auto document feeder (ADF). As illustrated in FIG. 1, the scanner 1 is provided to an upper part of a main body of the MFP 100. The scanner 1 is controlled by the system controller 5 to read the document image.

The printer 2 forms an image on, for example, a sheet as an image formed medium. The printer 2 forms the image by an electrophotographic system. The printer 2 forms the image using, for example, four types of non-erasable toners and one-type erasable toner. The four types of the non-erasable toners are the non-erasable toners of four colors, for example, yellow (Y), cyan (C), magenta (M) and black (K). The non-erasable toner is a toner that may not be decolorized even when being heated. In addition, the non-erasable toner is a so-called low-temperature fixable toner having a melting point, for example, at about 80 degree or lower. On the other hand, the erasable toner is an erasable toner (D) to be decolorized by being heated to a predetermined temperature (erasing temperature) or higher. Accordingly, the image to be printed using the erasable toner (D) is visually erasable. A color at the time of color-development of the erasable toner (D) is, for example, dark blue or black.

As described above, the erasable toner is the toner of which color is erasable by being heated to a decolorizing temperature or higher. The erasable toner becomes colorless by being decolorized. The erasable toner includes a binder resin, for example. The binder resin includes a color erasable coloring material. The color erasable coloring material includes a color forming compound, a color developing agent and an erasing agent. The color forming compound includes a leuco dye, for example. The color developing agent includes phenols, for example. The erasing agent includes a substance that is compatible with the color forming compound when being heated while having no affinity with the color developing agent. The color erasable coloring material develops a color by interaction between the color forming compound and the color developing agent. In addition, the color erasable coloring material is decolorized since the interaction between the color forming compound and the color developing agent is cut by being heated to the erasing temperature or higher. In the description hereinafter, erasing includes decolorization.

As illustrated in FIG. 1, the printer 2 includes a sheet feeding unit 20. The sheet feeding unit 20 includes a plurality of sheet feeding cassettes 20A, 20B and 20C. For example, each of the sheet feeding cassettes 20A to 20C is provided to a lower part of the main body of the MFP 100 in a detachable state. The sheet feeding cassettes 20A to 20C accommodate each type (for example, size or paper quality) of sheets set for each cassette. The sheet feeding unit 20 further includes pickup rollers 21A, 21B and 21C. The pickup rollers 21A to 21C are provided to the sheet feeding cassettes 20A to 20C, respectively. Each of the pickup rollers 21A to 21C takes out a sheet to be accommodated in each of the sheet feeding cassettes 20A to 20C in an order from the top in FIG. 1, and feeds the sheet to a conveying unit to be described hereinafter. The printer 2 may include a manually feeding tray (not illustrated) or the like as another sheet feeding unit. The sheet feeding unit 20 feeds a sheet to the conveying unit 22 so as to print an image onto the sheet.

Configuration information such as information regarding the sheet to be accommodated in each of the sheet feeding cassettes 20A to 20C is stored in a non-volatile memory such as a read-only memory (ROM) 53 to be described hereinafter. The printer 2 selects one sheet feeding cassette among the sheet feeding cassettes 20A to 20C accommodating the sheets to be used during the printing process, according to the configuration information. The printer 2 prints an image onto the sheet to be fed from the selected sheet feeding cassettes 20A to 20C. In a case where the printer 2 includes the manually feeding tray, a size of a sheet to be set in the manually feeding tray is also stored in the ROM 53 to be described hereinafter. The size of the sheet to be set in the manually feeding tray is input from, for example, the operation panel 4.

As illustrated in FIG. 1, the printer 2 includes the conveying unit 22 and a resist roller 24. The conveying unit 22 conveys the sheet in the printer 2 in cooperation with the resist roller 24 or the like. The conveying unit 22 includes a conveying member such as conveying rollers 22A, 22B and 22C. Each of the conveying rollers 22A to 22C is provided to each of the sheet feeding cassettes 20A to 20C. The conveying rollers 22A to 22C convey the sheet to be fed from the sheet feeding cassettes 20A to 20C by the pickup rollers 21A to 21C. The resist roller 24 is provided to an upstream position than a secondary transfer position to be described hereinafter in a conveying path of the sheet. The resist roller 24 conveys the sheet to the secondary transfer position at timing of transferring the image to the sheet from an intermediate transfer belt 27 to be described hereinafter.

Figure 3:
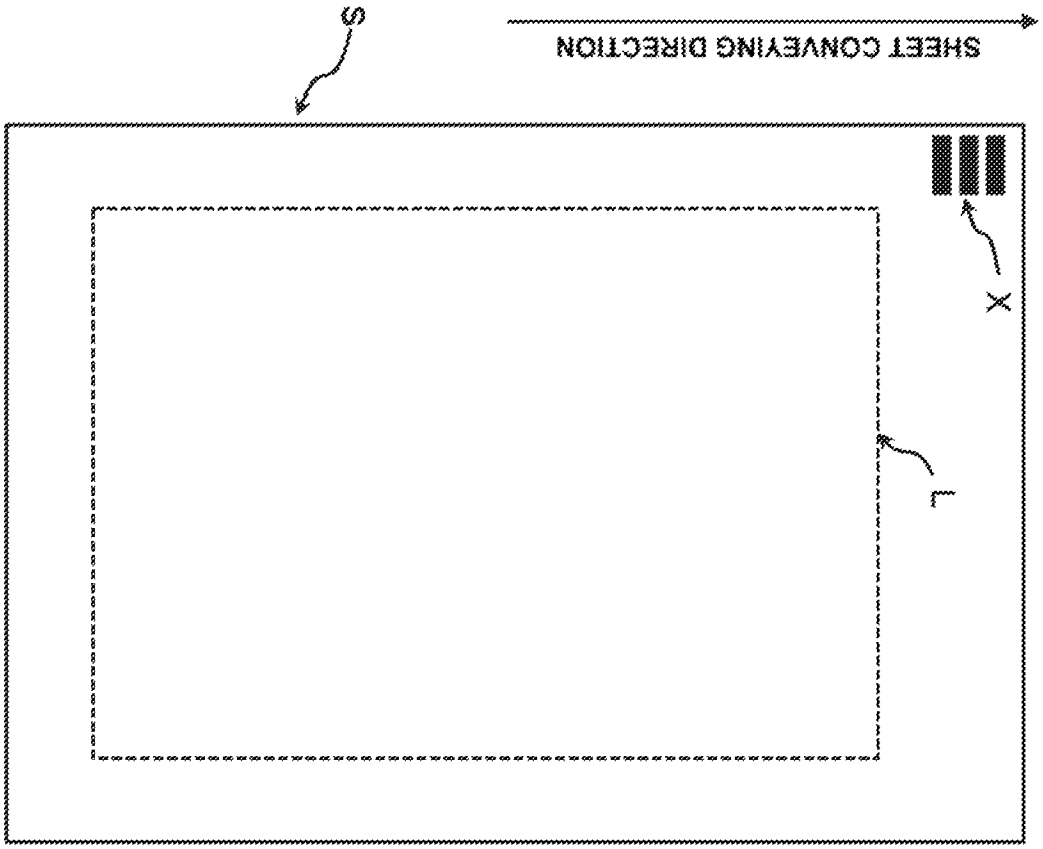
FIG. 3 is an explanatory diagram of a reused sheet to be used in the image forming apparatus according to the first embodiment.

As illustrated in FIG. 1, the printer 2 includes a sensor 23. The sensor 23 is provided to the conveying unit 22 between the sheet feeding unit 20 and the intermediate transfer belt 27, for example. More specifically, the sensor 23 is provided at an upstream side of the sheet conveying path than the resist roller in the sheet conveying direction, and further, at a downstream position than a merge position of a reverse conveying path by an automatic duplex unit 31 (ADU) to be described hereinafter. The sensor 23 is an optical sensor having a light emitting unit and a light receiving unit, for example. The sensor 23 may include a CCD sensor. The sensor 23 serves as an obtaining unit that obtains the information regarding the reuse of the sheet from the sheet to be conveyed. The information regarding the reuse of the sheet includes the number of times in which an image is printed to the sheet using the erasable toner so that the printed sheet may be reused. Hereinafter, this number of times of reuse will be simply referred to as the number of reuse. In addition, a sheet, on which an image is printed at least one time using the erasable toner and the image is erased by the image erasing apparatus, will be referred to as a reused sheet S. Accordingly, the number of reuse is recorded in the reused sheet S. The sensor 23 obtains the number of reuse recorded in the reused sheet S as the information regarding the reuse of the sheet. The number of reuse will be described in detail with reference to FIG. 3. FIG. 3 is a diagram illustrating the number of reuse recorded in the reused sheet S. As illustrated in FIG. 3, the number of reuse is indicated by a mark X to be printed to an end portion of the reused sheet S. The end portion of the reused sheet S is a region other than a region L in which the document image is printed, for example. The mark X includes a black horizontal line (a line in a direction orthogonal to the sheet conveying direction) indicating the number of reuse of the reused sheet S. One black horizontal line indicates one-time reuse, for example, the black horizontal line is printed one by one along the sheet conveying direction each time when an image is printed to a typical sheet or the reused sheet S using the erasable toner. FIG. 3 indicates that the reused sheet S is reused three times for printing using the erasable toner. In FIG. 3, the sensor 23 obtains the number of reuse indicated by the mark X by reading the mark X printed on the reused sheet S to be conveyed. In the present embodiment, as described hereinafter, the MFP 100 prints one black horizontal line as the mark X onto the sheet each time when printing is performed using the erasable toner. In addition, the MFP 100 prints the mark X using the non-erasable toner (for example, black (K)). Accordingly, the mark X is not decolorized when decolorizing the image printed onto the sheet using the image erasing apparatus (not illustrated).

As illustrated in FIG. 1, the printer 2 includes an image forming unit 25, an exposure unit 26, the intermediate transfer belt 27 and a transfer unit 28. The above-described units 25 to serve as an image forming means for forming an image. The image forming unit 25 forms an image to be transferred to a sheet in a photosensitive drum to be described hereinafter. The image forming unit 25 includes a plurality of image forming units 25Y, 25M, 25C, 25K and 25D. The image forming unit 25Y forms an image corresponding to yellow of the document image subjected to color separation using the Y-color non-erasable toner. The image forming unit 25M forms an image corresponding to magenta of the document image subjected to the color separation using the M-color non-erasable toner. The image forming unit 25C forms an image corresponding to cyan of the document image subjected to the color separation using the C-color non-erasable toner. The image forming unit 25K forms an image corresponding to black of the document image subjected to the color separation using the K-color non-erasable toner. The image forming units 25Y to 25K form an image corresponding to the document image by transferring the toner images of each color to the intermediate transfer belt 27 in a superimposed manner. The image forming units 25Y to 25K are used when the MFP 100 prints an image to a sheet using the non-erasable toner. In addition, for example, the image forming unit 25K is used so as to print the mark X indicating the number of reuse when the MFP 100 print an image to a sheet using the erasable toner. Meanwhile, the image forming unit 25D forms an image corresponding to the document image using the erasable toner, and primarily transfers the formed image to the intermediate transfer belt 27. The image forming unit 25D is used when the MFP 100 prints an image to a sheet using the erasable toner. For example, the image forming unit 25D is used in a case where an image is printed on a sheet, then the image is erased, and the sheet is reused. As described above, the color of the erasable toner is dark blue or black. Each of the image forming units 25Y to 25D includes a well-known configuration of, for example, the photosensitive drum, an electrostatic charger, a developing unit having the toners, a neutralizing unit, or the like so as to form the images of each color by the electrophotographic system.

The electrostatic charger of the image forming units 25Y to 25D uniformly charges the photosensitive drum before exposure by the exposure unit 26. The exposure unit 26 exposes each photosensitive drum by emitting, for example, a laser to each photosensitive drum of the image forming units 25Y, 25M, 25C, 25K and 25D after the charging by the electrostatic charger. The exposure unit 26 forms an electrostatic latent image corresponding to each color image to be printed by the exposure of each photosensitive drum. The image to be printed includes, for example, the document image, and an image of the mark X indicating the number of reuse. The exposure unit 26 controls power of the laser and emission of the laser to be irradiated onto each photosensitive drum corresponding to data of each color image of the image to be printed. For example, the exposure unit 26 controls the power of the laser corresponding to a control signal output from the system controller 5 on the basis of the data of each color image. For example, the exposure unit 26 controls a modulation amount of a pulse width corresponding to the control signal from the system controller 5 so as to control the emission of the laser. The exposure unit 26 emits the laser corresponding to each color image to each photosensitive drum by an optical system such as a polygon mirror. For example, in the case where the MFP 100 prints an image using the non-erasable toner, the exposure unit 26 forms an electrostatic latent image corresponding to each color image of the document image by emitting the laser to each photosensitive drum of the image forming units 25Y, 25M, 25C and 25K. Meanwhile, in the case where the MFP 100 prints an image using the erasable toner, the exposure unit 26 forms an electrostatic latent image corresponding to the document image by emitting the laser to the photosensitive drum of the image forming unit 25D. In addition, the exposure unit 26 forms an electrostatic latent image corresponding to the mark X indicating the number of reuse by emitting the laser to, for example, the photosensitive drum of the image forming unit 25K. The electrostatic latent image to be formed in each photosensitive drum is developed using each color toner as described hereinafter.

Each developing unit of the image forming units 25Y to 25D develops the electrostatic latent image by supplying each color toner to the photosensitive drum. Each developing unit forms an image using each color as a visible image onto the photosensitive drum by developing the electrostatic latent image. Each of the image forming units 25Y to 25D primarily transfers the image using each color toner from the photosensitive drum to the intermediate transfer belt 27. More specifically, the image forming units 25Y to 25D apply a transfer bias to a portion between the photosensitive drum and the intermediate transfer belt 27 at the primary transfer position so as to transfer the image. The system controller 5 controls the transfer bias for the primary transfer process. For example, in the case where the MFP 100 performs printing using the non-erasable toner, each of the image forming units 25Y to 25K forms an image using the non-erasable toner corresponding to the document image on each photosensitive drum. Each of the image forming units 25Y to 25K primarily transfers the image using the non-erasable toner from the photosensitive drum to the intermediate transfer belt 27 by the transfer bias. For example, in the case where the MFP 100 performs printing using the erasable toner, the image forming unit 25D forms an image using the erasable toner corresponding to the document image onto the photosensitive drum. In addition, for example, the image forming unit 25K forms an image using the non-erasable toner corresponding to the mark X indicating the number of reuse. The image forming units 25K and 25D primarily transfer the image using the erasable toner and the image using non-erasable toner, respectively, to the intermediate transfer belt 27 by the transfer bias in a superimposed manner. As illustrated in FIG. 1, the intermediate transfer belt 27 is provided to be capable of endlessly traveling along the image forming units 25Y to 25K by being stretched on a plurality of rollers such as a support roller 28*a*. The intermediate transfer belt 27 is an intermediate transfer member to which the toner image is primarily transferred as described above. The intermediate transfer belt 27 conveys the toner image to the secondary transfer position to be described hereinafter by endlessly traveling while carrying the primarily-transferred toner image.

In addition, each of the image forming units 25Y to 25D includes a sensor (not illustrated) such as a potential sensor and a density sensor. The potential sensor detects a surface potential of the photosensitive drum. More specifically, as described above, the image forming units 25Y to 25D uniformly charge the photosensitive drum using the electrostatic charger before the exposure by the exposure unit 26. The system controller 5 may change a charging condition by the electrostatic charger. The potential sensor detects a surface potential in the photosensitive drum charged by the electrostatic charger. The density sensor detects density of the toner image primarily transferred to the intermediate transfer belt 27. The density sensor may detect density of the toner image formed on the photosensitive drum.

The transfer unit 28 transfers the toner image on the intermediate transfer belt 27 to the sheet in the secondary transfer position. The transfer unit 28 includes the support roller 28*a* and a secondary transfer roller 28*b* provided along the sheet conveying path. The support roller 28*a* and the secondary transfer roller 28*b* face each other with the intermediate transfer belt 27 interposed therebetween in the secondary transfer position. The transfer unit 28 applies a secondary transfer bias to a portion between the intermediate transfer belt 27 and the secondary transfer roller so as to transfer the image to the sheet. The system controller 5 controls the secondary transfer bias for the secondary transfer process.

As illustrated in FIG. 1, the printer 2 further includes a fixer 29. The fixer 29 serves a function of allowing the transferred toner image to be fixed to the sheet. For example, the fixer 29 fixes the toner image to the sheet by heating the toner image at a predetermined fixing temperature, and further pressing the toner image to the sheet.

The fixer 29 illustrated in FIG. 1 includes a heat source 29*a*, a heat roller 29*b* and a pressure roller 29*c*. The heat source 29*a* is built in the heat roller 29*b*. The pressure roller 29*c* is in contact with the heat roller 29*b* in a pressurized state. The pressure roller 29*c* may be in contact with a fixing belt to be heated by the heat roller 29*b* in the pressurized state. The heat source 29*a* is a heater capable of controlling temperature of the heat roller 29*b*. For example, the heat source 29*a* may be a heater lamp such as a halogen lamp, or an induction heating (IH) system heater. The heat source 29*a* may have a plurality of heaters. The fixer 29 further includes a temperature sensor for measuring temperature of the heat roller 29*b*.

In a case where the fixer 29 performs the fixing process, the system controller 5 controls the heat source 29*a* such that the heating temperature of the heat roller 29*b* of the fixer 29 becomes the predetermined fixing temperature. The fixer 29 conveys the sheet onto which the toner image is transferred while nipping the sheet between the heat roller 29*b* and the pressure roller 29*c*. The heat roller 29*b* heats the toner image at the fixing temperature by heat of the heat source 29*a* while conveying the sheet. The pressure roller 29*c* presses the toner image to the sheet while conveying the sheet. The fixer 29 fixes the toner image to the sheet by heating at the fixing temperature while pressing. The image printing process of the MFP 100 is completed when the toner image is fixed to the sheet. In accordance to a process request of a user received by the MFP 100 via the operation panel 4, the fixer 29 discharges the sheet in which the image is printed on single side thereof outside the MFP, or conveys the sheet to the ADU 31 to be described hereinafter. As illustrated in FIG. 1, the MFP 100 includes a discharge unit 30. The discharge unit 30 receives the sheet in which the image is printed to be discharged outside the MFP 100. The discharge unit 30 accommodates the sheets to be discharged in a stacked state, for example.

A description will be made regarding the fixing temperature in the case where the MFP 100 prints an image using the erasable toner so as to allow the printed sheet to be reusable. As described above, in the case where the MFP 100 prints the image using the erasable toner, the image using the erasable toner corresponding to the document image and the image using the non-erasable toner corresponding to the mark X indicating the number of reuse are transferred to the sheet. The fixer 29 fixes the image using the erasable toner and the image using non-erasable toner to the sheet together. Accordingly, the fixing temperature of the fixer 29 is controlled to be the temperature at which the erasable toner and the non-erasable toner may be fixed, and further, to be the temperature at which the erasable toner is not decolorized. More specifically, the system controller 5 controls the heating temperature of the fixer 29 to be the fixing temperature corresponding to the erasable toner and the non-erasable toner. The fixing temperature is the temperature lower than an erasing temperature of the erasable toner.

In the case where the MFP 100 receives the process request for the simplex printing from the user via the operation panel 4, the fixer 29 conveys the sheet in which the image is fixed to single side thereof to the discharge unit 30 outside the MFP, as described above. Meanwhile, as illustrated in FIG. 1, the MFP 100 includes the ADU 31 for duplex printing. In the case where the operation panel 4 receives the process request for the duplex printing from the user, the MFP 100 once conveys the sheet in which the image is fixed to single side thereof to the discharge unit 30 side, and then switches back the sheet conveying direction to convey the sheet to the ADU 31. As illustrated in FIG. 1, the ADU 31 includes the reverse conveying path of the sheet which is merged at the upstream position than the sensor 23 in the sheet conveying path of the conveying unit 22. The ADU 31 returns the sheet of which the front and back are reversed to the upstream position than the sensor 23 by the merged reverse conveying path. The ADU 31 feeds the sheet to the resist roller 24 again by returning the sheet to the upstream position than the sensor 23.

Incidentally, in the case where the MFP 100 performs the printing using the erasable toner so as to allow the printed sheet to be reusable, the system controller 5 to be described hereinafter sets the target fixing temperature of the fixer 29 on the basis of a value (the number of horizontal lines of the mark X) of the number of reuse, which is printed on the sheet.

The operation panel 4 is a user interface that receives the process request from the user. For example, the operation panel 4 receives an input of the information required for the printing such as the number of printed sheets and the printing density as a printing process request. The operation panel 4 includes various types of buttons so as to receive the process request from the user. In addition, the operation panel 4 includes a display 4*a* having a touch panel 4*b*. The system controller 5 controls content to be displayed on the display 4*a* of the operation panel 4. The operation panel 4 outputs the information regarding the process request received from the user to the system controller 5 via the touch panel 4*b* of the display 4*a* or a button.

Figure 2:
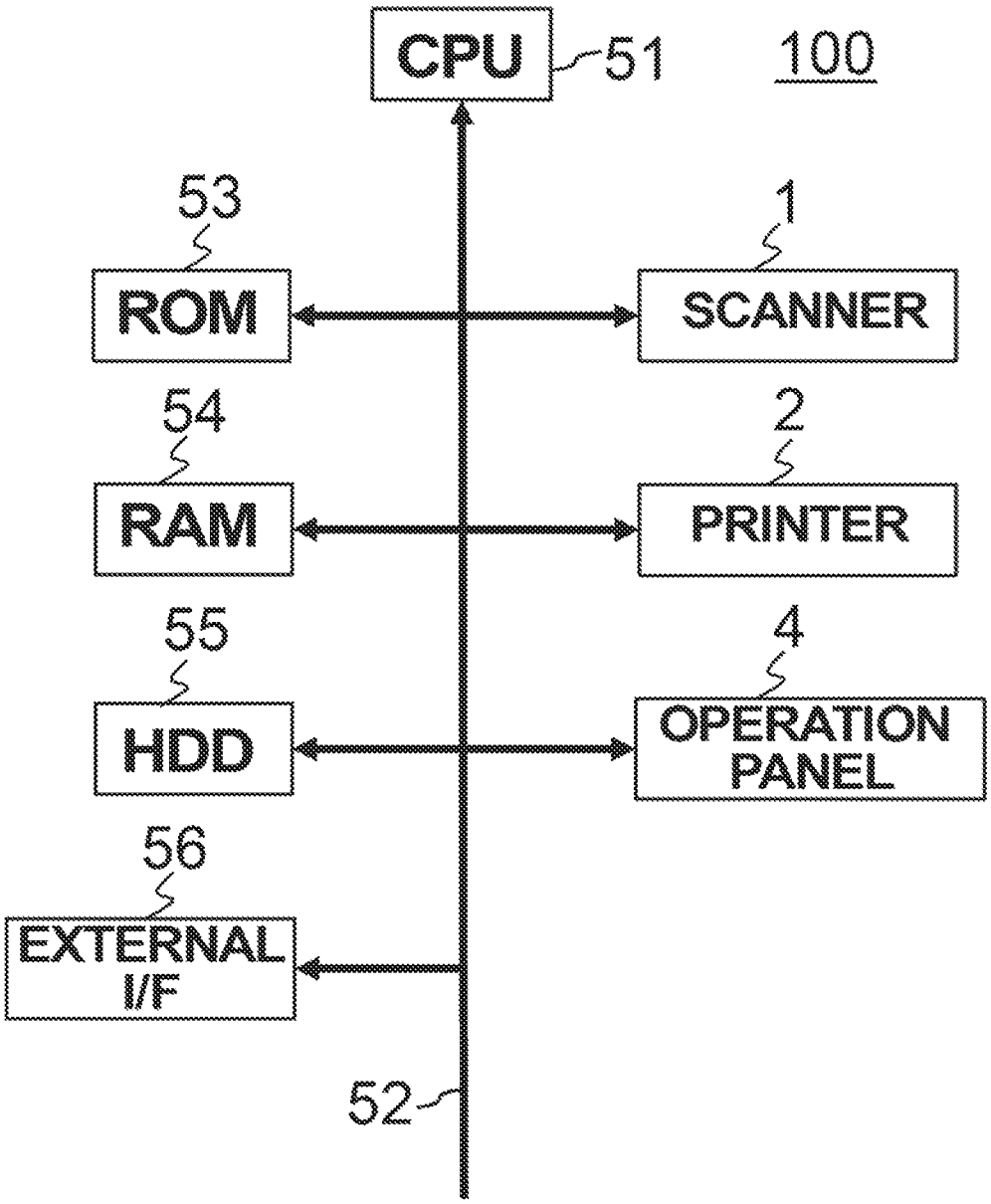
FIG. 2 is a block diagram of the image forming apparatus according to the first embodiment.

Hereinafter, a description will be made regarding the configuration of a control system of the MFP 100 with reference to FIG. 2. FIG. 2 is a block diagram of the MFP 100. As illustrated in FIG. 2, the MFP 100 includes a central processing unit (CPU) 51, the ROM 53 and a random access memory (RAM) 54 as the system controller 5. In addition, the MFP 100 includes a hard disk drive (HDD) 55 as the non-volatile memory other than the ROM 53. In addition, the MFP 100 includes an external interface (I/F) 56. The CPU 51, the ROM 53, the RAM 54, the HDD 55, the external I/F 56, the printer 2 and the operation panel 4 are connected to each other via a system bus 52.

The ROM 53 stores a program for operating the CPU 51 or a threshold value in advance. In addition, the ROM 53 stores various types of the configuration information set in advance in the MFP 100. The configuration information includes the information regarding the sheet accommodated in each of the sheet feeding cassettes 20A to 20C. The configuration information stores, for example, the fixing temperature corresponding to the non-erasable toner to be described hereinafter. In addition, the ROM 53 may store the fixing temperature of the erasable toner or the like instead of the HDD 55 to be described hereinafter.

The RAM 54 dynamically forms various memory areas such as a work area which is a work area of a data process by the program. For example, the RAM 54 includes a temporary storage area which temporarily stores the image data read from the scanner 1. In addition, the RAM 54 includes a number-of-reuse storage area which stores the number of reuse indicated by the mark X read from the sensor 23. The RAM 54 stores "0" in the number-of-reuse storage area as a default value. In addition, the RAM 54 includes a temperature storage area which stores the fixing temperature of each color. The fixing temperature is the temperature at which a toner transferred to a sheet is fixed to the sheet. The RAM 54 stores the highest fixing temperature required for fixing the erasable toner as a default value of the fixing temperature in the temperature storage area. The highest fixing temperature is a fixing temperature corresponding to the default value "0" of the number of reuse, for example, is 96 degree (see FIG. 4). The fixing temperature of the erasable toner is stored in the HDD 55 corresponding to the number of reuse as described hereinafter. The system controller 5 to be described hereinafter reads the default value of the fixing temperature from the HDD 55 each time when the MFP 100 is started. The system controller 5 stores the read default value of the fixing temperature in the temperature storage area of the RAM 54.

The HDD 55 stores an operating system (OS) for operating the MFP 100, which is to be installed in the MFP 100. In addition, the HDD 55 stores a configuration file 551 for controlling the heating temperature of the fixer 29. A description will be made regarding the configuration file 551 of the fixer 29 with reference to FIG. 4. FIG. 4 is a diagram illustrating the configuration file 551 of the fixer 29. As illustrated in FIG. 4, the configuration file 551 includes the number-of-reuse area and the fixing temperature storage area corresponding to the number-of-reuse storage area. The number-of-reuse area stores the number of reuse of the sheet. The fixing temperature storage area stores the fixing temperature of the erasable toner corresponding to the number of reuse of the number-of-reuse area. In other words, the configuration file 551 stores the fixing temperature corresponding to the number of reuse in advance for each number of reuse. The stored fixing temperature is temperature lower than the erasing temperature. The system controller 5 temporarily stores the number of reuse indicated by the mark X read from the sensor 23 in the number-of-reuse storage area of the RAM 54. The system controller 5 retrieves the configuration file 551 using a value of the number of reuse temporarily stored in the number-of-reuse storage area of the RAM 54 as a retrieval key. The system controller 5 reads the fixing temperature corresponding to the number of reuse of the retrieval key as the result of the retrieval from the fixing temperature storage area of the configuration file 551. The system controller 5 stores the read fixing temperature in the temperature storage area of the RAM 54. The system controller 5 sets the fixing temperature stored in the temperature storage area of the RAM 54 to the target fixing temperature. The system controller 5 controls the heating temperature by the heat source 29*a* of the fixer 29 on the basis of the set target fixing temperature. In other words, the system controller 5 controls the heating temperature of the fixer 29 such that the target fixing temperature of the fixer 29 becomes the fixing temperature corresponding to the number of reuse. A maximum number of reuse of the number-of-reuse area of the configuration file 551 is the limit number of reuse of the sheet that may be printed using the erasable toner. The maximum number of reuse is a value determined in advance. The maximum number of reuse of the number-of-reuse area of the configuration file 551 illustrated in FIG. 4 is "7". In a case where the number of reuse read by the sensor 23 is larger than "7", the system controller 5 determines that the number of reuse of the sheet exceeds the limit. For example, even in the case where the operation panel 5 receives information required for the printing process using the erasable toner from the user, as described above, the MFP 100 performs the printing process using the non-erasable toner when the system controller 5 determines that the number of reuse of the sheet exceeds the limit. The reason of being switched to the printing process using the non-erasable toner is because degradation of the sheet is introduced when the printing is performed using the erasable toner with respect to the sheet exceeding the limit number of reuse. The degraded sheet causes generation of jam in the MFP 100. A failure occurs in the printing process of the MFP 100.

Figure 5:
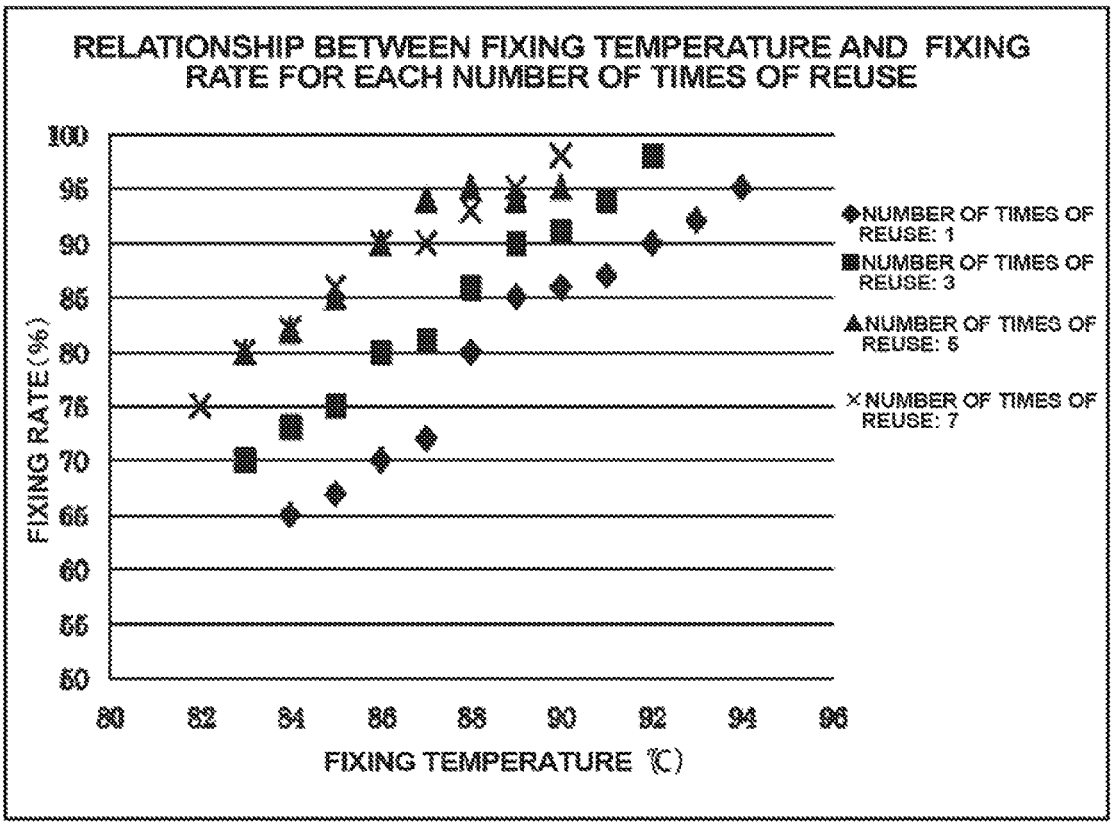
FIG. 5 is a diagram illustrating a relationship between the fixing temperature and a fixing rate for each number of times of reuse in the image forming apparatus according to the first embodiment.

Hereinafter, a description will be made regarding a relationship between the number of reuse of the sheet and the fixing rate with reference to FIG. 5. FIG. 5 is an explanatory diagram illustrating an experiment result in which the relationship between the fixing temperature and the fixing rate is floated corresponding to the number of reuse. In FIG. 5, the vertical axis is the fixing rate, and the horizontal axis is the fixing temperature. In FIG. 5, "◆" is plotted to indicate a relationship between the fixing temperature and the fixing rate for the number of reuse of the "first time". Similarly, "■" is plotted to indicate a relationship between the fixing temperature and the fixing rate for the number of reuse of the "third time". Similarly, "▲" is plotted to indicate a relationship between the fixing temperature and the fixing rate for the number of reuse of the "fifth time". Similarly, "x" is plotted to indicate a relationship between the fixing temperature and the fixing rate for the number of reuse of the "seventh time". As illustrated in FIG. 5, as the number of reuse of the sheet increases, the fixing rate is improved. In other words, as the number of reuse of the sheet increases more and more, it is possible to fix the erasable toner to the sheet at lower temperature. For example, it is possible to fix the erasable toner at lower temperature in a case where the erasable toner is fixed to the sheet of which the number of reuse is seven compared to a case where the erasable toner is fixed to the sheet of which the number of reuse is one. The fixing rate is a value obtained by a well-known method. For example, density of a toner image fixed onto a sheet of 1 $cm^2$ is measured. Subsequently, a peeling tape is attached onto the toner image on the sheet and then the tape is peeled off, and the density of the toner image on the sheet after the peeling-off is measured. The fixing rate is set using a value expressing the value measured after the peeling-off in percentage when the value measured before the peeling-off is 100.

The external I/F 56 to be connected to the system bus illustrated in FIG. 2 is an interface for communication with an external apparatus. The external I/F 56 receives a print request and document image data to be printed from, for example, a client terminal (PC). The external I/F 56 may be an interface that performs data communication with the external apparatus, and may be, such as, a USB memory to be locally connected to the external apparatus. In addition, the external I/F 56 may be a network interface for communication via a network.

The scanner 1 to be connected to the system bus of FIG. 2 is controlled by the system controller 5 to scan the document so as to obtain the document image as described above. Similarly, the printer 2 is controlled by the system controller 5 to form the image using the toner as described above and to fix the formed image to the sheet. Similarly, the operation panel 4 receives the process request from the user under the control of the system controller 5.

Figure 6:
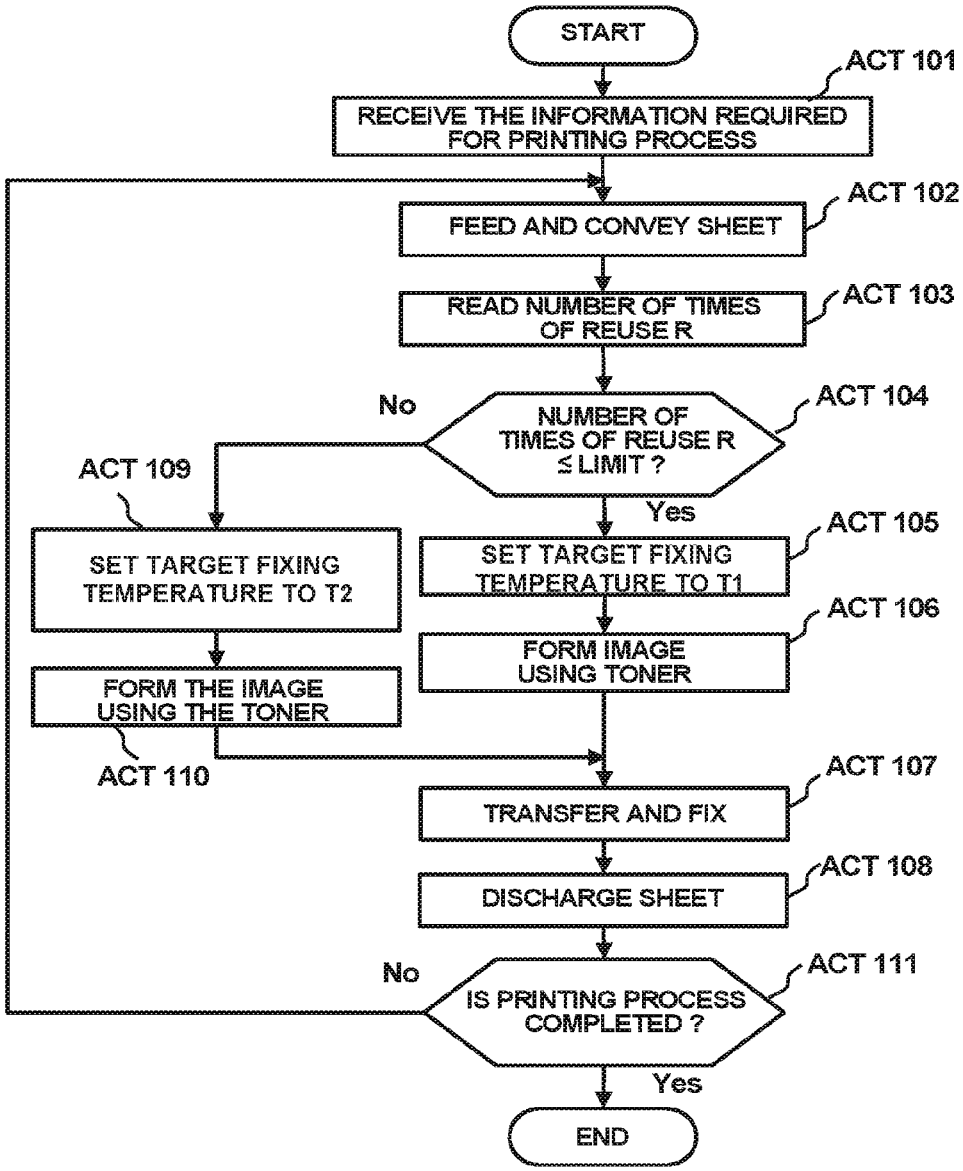
FIG. 6 is a flowchart illustrating a printing process of the image forming apparatus according to the first embodiment.

Hereinafter, a description will be made regarding the printing process performed by the MFP 100 according to the first embodiment with reference to FIG. 6. FIG. 6 is a flowchart illustrating the printing process of the MFP 100. The ROM 53 stores the program for the printing process in advance. The program includes an instruction for the printing process. The system controller 5 allows the MFP 100 to execute the printing process by controlling the operation of each above-described unit of the MFP 100 on the basis of the instruction.

The printing process to be described hereinafter is a so-called copy process of printing a document image placed on the document table glass (not illustrated) of the MFP 100 by a user. The MFP 100 obtains image data of the document by scanning the document using the scanner 1. In addition, the MFP 100 uses the reused sheet S as a sheet onto which an image is printed. As described above, the reused sheet S is the sheet in which the image is printed at least one time using the erasable toner, and further, the image is erased by the image erasing apparatus. The reused sheet S is accommodated in advance in, for example, the sheet feeding cassette 20B among the sheet feeding cassettes 20A to 20C by the user. The mark X illustrated in FIG. 3 is printed on every reused sheet S accommodated in the sheet feeding cassette 20B. As described above, the mark X is the mark indicating the number of reuse of the sheet. In addition, the MFP 100 prints the document image using the erasable toner so that the reused sheet S after printing may be further reused. Incidentally, the MFP 100 may obtain the image data to be printed from a personal computer (PC) as the client terminal using the external I/F 56, in addition to the copy process.

As illustrated in FIG. 6, in ACT 101, the system controller receives the information required for the printing process from the user via the operation panel 4. The information required for the printing process includes information that the copy process using the erasable toner is selected as the printing process and that the reused sheet S of the sheet feeding cassette B is selected as a sheet to be printed. In addition, the information required for the printing process includes the number of sheets to be copied, the printing density and the like. The system controller 5 stores the received information required for the printing process in a predetermined area of the RAM 54. The system controller 5 further receives a start instruction of the printing process from the user via the operation panel 4 after receiving the information required for the printing process. The system controller 5 causes each unit of the MFP 100, such as the scanner 1, the exposure unit 26 and the image forming units 25K and 25D, to operate on the basis of the information required for the printing process stored in the RAM 54. In ACT 101, when the system controller 5 receives the information required for the printing process and the start instruction of the printing process, the operation of the MFP 100 proceeds to ACT 102.

In ACT 102, the system controller 5 controls the sheet feeding unit 20 and the conveying unit 22. The pickup roller 21B of the sheet feeding unit 20 is controlled by the system controller 5 to take out the reused sheet S from the sheet feeding cassette 20B and to feed the sheet to the conveying unit 22. The conveying unit 22 is controlled by the system controller 5 to convey the reused sheet S to the resist roller 24. In ACT 102, when the system controller 5 starts the conveyance control of the reused sheet S, the operation of the MFP 100 proceeds to ACT 103.

In ACT 103, the system controller 5 controls the sensor 23. The sensor 23 is controlled by the system controller 5 to read the mark X (see FIG. 3) printed on the reused sheet S which is being conveyed to the resist roller 24. The system controller 5 stores the number of reuse of the sheet indicated by the read mark X in the number-of-reuse storage area of the RAM 54. Hereinafter, the number of reuse stored in the number-of-reuse storage area of the RAM 54 will be referred to as a number of reuse R. In ACT 103, when the system controller 5 reads the mark X (the number of reuse) using the sensor 23, the operation of the MFP 100 proceeds to ACT 104.

In ACT 104, the system controller 5 retrieves the number-of-reuse area (see FIG. 4) of the configuration file 551 of the HDD 55 using the number of reuse R as the retrieval key. The system controller 5 determines whether or not the number of reuse R is equal to or smaller than the maximum number of reuse stored in the number-of-reuse area of the configuration file 551 on the basis of the result of the retrieval. As described above, the maximum number of reuse is the limit number of reuse of the sheet. In other words, the system controller 5 determines whether or not the number of reuse of the reused sheet S exceeds the limit by comparing the number of reuse R and the limit number of reuse. More specifically, the maximum number of reuse stored in the configuration file 551 illustrated in FIG. 4 is "7". Accordingly, the system controller 5 determines whether or not the number of reuse R is equal to or smaller than seven.

In a case where the system controller 5 determines that the number of reuse R is equal to or smaller than the maximum number of reuse of "7", that is, the case where the system controller 5 determines that the number of reuse R of the sheet does not exceed the limit (Yes in ACT 104), the operation of the MFP 100 proceeds to ACT 105. In ACT 105, the system controller 5 further retrieves the number-of-reuse area of the configuration file 551 using the number of reuse R as the retrieval key. The system controller 5 reads the fixing temperature corresponding to the number of reuse R from the fixing temperature storage area (see FIG. 4) of the configuration file 551 on the basis of the result of the retrieval. The system controller 5 stores the read fixing temperature in the temperature storage area of the RAM 54. Hereinafter, a value of the fixing temperature of the erasable toner stored in the temperature storage area of the RAM 54 will be referred to as a fixing temperature T1. The fixing temperature T1 is used as the target fixing temperature for controlling the heating temperature of the fixer 29. In other words, the system controller 5 sets the target fixing temperature for controlling the heating temperature of the fixer as the fixing temperature T1. The system controller 5 increases the heating temperature of the fixer 29 until the heating temperature of the fixer 29 becomes the fixing temperature T1 by controlling the heat source 29*a*. The reused sheet S to be fed from the sheet feeding cassette 20B waits in front of the resist roller 24 until the heating temperature of the fixer 29 becomes the fixing temperature T1 as the target fixing temperature. In ACT 105, when the system controller 5 sets the target fixing temperature, the operation of the MFP 100 proceeds to ACT 106.

In ACT 106, the system controller 5 forms the image to be transferred to the sheet using the erasable toner and the non-erasable toner by controlling the exposure unit 26 of the printer 2, the image forming units 25K and 25D and the like. More specifically, the exposure unit 26 forms the electrostatic latent image corresponding to the document image on the photosensitive drum of the image forming unit 25D. In addition, the exposure unit 26 forms the electrostatic latent image corresponding to the mark X on the photosensitive drum of the image forming unit 25K. The image forming unit 25D forms the image using the erasable toner corresponding to the document image on the photosensitive drum by developing the electrostatic latent image of the photosensitive drum. In addition, the image forming unit 25D primarily transfers the formed image using the erasable toner to the intermediate transfer belt 27. The image forming unit 25K forms the image using the non-erasable toner corresponding to the mark X on the photosensitive drum by developing the electrostatic latent image of the photosensitive drum. In addition, the image forming unit 25K primarily transfers the image using the non-erasable toner to the intermediate transfer belt 27 to which the image using the erasable toner is already transferred. Here, the mark X read by the sensor 23 before the printing of the image includes the three horizontal lines as illustrated in FIG. 3. That is, the reused sheet S illustrated in FIG. 3 is a sheet that is already used three times for the printing using the erasable toner. On the other hand, the mark X to be printed on the reused sheet S after the printing of the image using the erasable toner includes four horizontal lines by being added with one horizontal line in the sheet conveying direction. Accordingly, the electrostatic latent image corresponding to the mark X to be formed by the exposure unit 26 corresponds to the one horizontal line to be added in the sheet conveying direction. In addition, similarly, the image using the non-erasable toner corresponding to the mark X to be formed by the image forming unit 25K corresponds to the one horizontal line. As described above, the intermediate transfer belt 27 conveys the image using the erasable toner and the image using the non-erasable toner, which are primarily transferred, to the secondary transfer position. In ACT 106, when the system controller 5 forms the toner image to be transferred to the sheet by the control of the printer, the operation of the MFP 100 proceeds to ACT 107.

In ACT 107, the system controller 5 determines that the heating temperature of the fixer 29 reaches the fixing temperature T1 as the target fixing temperature and formation timing of the toner image by the image forming units 25K and 25D to control the operation of the resist roller 24. The resist roller 24 conveys the reused sheet S that waits to the secondary transfer position in accordance with the formation timing of the toner image. In addition, the system controller 5 controls the transfer unit 28. The transfer unit 28 transfers the erasable toner image corresponding to the document image and the image using the non-erasable toner corresponding to the mark X to the reused sheet S from the intermediate transfer belt 27. In addition, the system controller 5 controls the fixer 29. The fixer 29 fixes the erasable toner image and the image using the non-erasable toner to the reused sheet S at the fixing temperature T1. Incidentally, as described above, the non-erasable toner is the low-temperature fixable toner. Accordingly, it is possible to fix the image using the erasable toner without decolorization at the fixing process at the fixing temperature T1. Further, it is also possible to sufficiently fix the image using the non-erasable toner. On the contrary, in a case where the non-erasable toner is not the low-temperature fixable toner, the fixer 29 may fix the image using the non-erasable toner along with the image using the erasable toner by changing the conveying speed of the sheet by the heat roller 29*b* and the pressure roller 29*c*, and the pressure to the sheet by the heat roller 29*b* and the pressure roller 29*c*.

Meanwhile, in ACT 104, in a case where the system controller 5 determines that the number of reuse R is larger than the maximum number of reuse of "7", that is, a case where the system controller 5 determines that the number of reuse R of the sheet exceeds the limit (No in ACT 104), the operation of the MFP 100 proceeds to ACT 109. In ACT 109, the system controller 5 reads the fixing temperature corresponding to the non-erasable toner from the ROM 53. The system controller 5 stores the read fixing temperature of the non-erasable toner in the temperature storage area of the RAM 54. Hereinafter, a value of the fixing temperature of the non-erasable toner stored in the temperature storage area of the RAM 54 will be referred to as a fixing temperature T2. The fixing temperature T2 is used as the target fixing temperature for controlling the heating temperature of the fixer 29. In other words, the system controller 5 sets the target fixing temperature for controlling the heating temperature of the fixer 29 as the fixing temperature T2. The system controller 5 controls the heat source 29*a* to increase the heating temperature of the fixer 29 until the heating temperature of the fixer 29 becomes the fixing temperature T2 as the target fixing temperature. The reused sheet S to be fed from the sheet feeding cassette 20B waits in front of the resist roller 24 until the heating temperature of the fixer 29 becomes the fixing temperature T2 as the target fixing temperature. In ACT 109, when the system controller 5 sets the target fixing temperature, the operation of the MFP 100 proceeds to ACT 110.

In ACT 110, since the number of reuse of the reused sheet S exceeds the limit, the system controller 5 controls the printer such that the reused sheet S after the printing may not be reused. That is, the system controller 5 controls the exposure unit 26 of the printer 2, the image forming units 25Y to 25K (for example, the image forming unit 25K) and the like to form the image using the non-erasable toner to be transferred to the sheet. More specifically, the exposure unit 26 forms the electrostatic latent image corresponding to the document image on the photosensitive drum of the image forming unit 25K. In addition, the exposure unit 26 forms the electrostatic latent image corresponding to reuse limit information of the reused sheet S on the photosensitive drum of the image forming unit 25K instead of the mark X to be added. The reuse limit information is the information indicating that the number of reuse is larger than the maximum number of reuse, that is, that the number of reuse exceeds the limit. The reuse limit information includes letters such as "END". The image forming unit 25K forms the image using the non-erasable toner corresponding to the document image and the letters of "END" on the photosensitive drum by developing the electrostatic latent image of the photosensitive drum. In addition, the image forming unit 25K primarily transfers the image using the non-erasable toner to the intermediate transfer belt 27 from the photosensitive drum. The intermediate transfer belt 27 conveys the primarily transferred image using the non-erasable toner to the secondary transfer position. In ACT 110, when the system controller 5 forms the toner image to be transferred to the sheet by the control of the printer, the operation of the MFP 100 proceeds to ACT 107.

In ACT 107, the system controller 5 determines that the heating temperature of the fixer 29 reaches the fixing temperature T2 as the target fixing temperature, and the formation timing of the toner image by the image forming unit 25K to control the operation of the resist roller 24. The resist roller 24 conveys the reused sheet S that waits to the secondary transfer position in accordance with the formation timing of the toner image. In addition, the system controller 5 controls the transfer unit 28. The transfer unit 28 transfers the images using the non-erasable toner corresponding to the document image and the letters of "END" to the reused sheet S from the intermediate transfer belt 27. In addition, the system controller 5 controls the fixer 29. The fixer 29 fixes the images using the non-erasable toner to the sheet at the fixing temperature T2.

In ACT 107, when the fixing process using the fixer 29 is completed, the operation of the MFP 100 proceeds to ACT 108. In ACT 108, the system controller 5 controls the conveyance of the sheet to convey the reused sheet S to the discharge unit 30. The discharge unit 30 accommodates the reused sheets S on which the image is printed in the laminated state. In ACT 108, when the sheet is conveyed to the discharge unit 30, the operation of the MFP 100 proceeds to ACT 111.

In ACT 111, the system controller 5 refers to the information (ACT 101) required for the printing process stored in the predetermined area of the RAM 54. The system controller 5 refers to the information required for the printing process to determine whether or not the printing process is completed. For example, when the system controller 5 determines that there is the remaining number of sheets to be printed in relation to the number of copies requested by the user (No in ACT 111), the operation of the MFP 100 returns to ACT 102. On the contrary, when the system controller 5 determines that the printing of the number of copies requested by the user is completed (Yes in ACT 111), the system controller 5 terminates the printing process job of the MFP 100.

As described above, the MFP 100 according to the first embodiment may control the fixing temperature of the fixer 29 on the basis of the number of reuse of the sheet recorded on the sheet in the case where the document image is printed using the erasable toner. Accordingly, the MFP 100 may fix the image to the reused sheet S at an appropriate fixing temperature even in a case where the reused sheet S on which the decolorized toner is left is reused to print the image. In addition, as illustrated in FIG. 5, as the sheet is reused more and more, it is possible to fix the toner image to the sheet at lower temperature. Accordingly, the MFP 100 may decrease the target fixing temperature at the fixing process. Therefore, according to the first embodiment, it is possible to provide the image forming apparatus which is power-saving and environmentally friendly.

Hereinafter, a second embodiment will be described with reference to FIGS. 7 and 8. In the drawings, the same configuration as in the first embodiment will be attached with the same reference numeral and the description thereof will be omitted. An MFP 100 according to the second embodiment has the configurations of FIGS. 1 and 2. In the second embodiment, the HDD 55 illustrated in FIG. 2 stores a second configuration file 552 for controlling the heating temperature of the fixer 29 instead of the configuration file 551. The configuration file 552 of the fixer 29 will be described with reference to FIG. 7. FIG. 7 is a diagram illustrating the configuration file 552 of the fixer 29. As illustrated in FIG. 7, the configuration file 552 includes a number-of-reuse range area and the fixing temperature storage area corresponding to the number-of-reuse range area. The number-of-reuse range area stores a range of the number of reuse. The number-of-reuse range is a predetermined range such as "zero to one" and "two to three". The fixing temperature storage area stores the fixing temperature corresponding to the number of reuse included in the predetermined range of the number of reuse. In other words, the configuration file 552 stores the fixing temperature corresponding to the number of reuse in advance for each predetermined range of the number of reuse. The number-of-reuse range of "zero to one" corresponds to the default value of the number of reuse in the first embodiment. A fixing temperature of "95 degree" corresponding to the number-of-reuse range of "zero to one" corresponds to the default value of the fixing temperature in the first embodiment.

Hereinafter, a description will be made regarding a printing process performed by the MFP 100 of the second embodiment having the configuration file 552 with reference to FIG. 8. FIG. 8 is a flowchart illustrating the printing process of the MFP 100 according to the second embodiment. Similarly to the first embodiment, the system controller 5 of the MFP 100 controls the operation of each unit of the MFP 100 according to an instruction of a program stored in the ROM 53 to cause the MFP 100 to execute the printing process. In the printing process illustrated in FIG. 8, in a case where the number of reuse of the sheet is not readable by the sensor 23, the fixing temperature that is already stored in the temperature storage area of the RAM 54 is used as the target fixing temperature for controlling the heating temperature of the fixer 29. In the printing process illustrated in FIG. 8, similarly to the first embodiment, the reused sheet S is accommodated in the sheet feeding cassette 20B. However, different from the first embodiment, the reused sheets S are accommodated in the sheet feeding cassette 20B by being collected for each bundle of the reused sheets S of which the number of reuse is the same. In addition, the reused sheets S are accommodated in the sheet feeding cassette 20B in descending order of the number of reuse. For example, the reused sheets S of which the number of reuse is three are accommodated in the sheet feeding cassette 20B in a bundle by the user. Further, the reused sheets S are accommodated in the sheet feeding cassette 20B in an order of the bundle of the reused sheets S of which the number of reuse is three and then a bundle of the reused sheets S of which the number of reuse is one. Accordingly, in FIG. 1, the bundle of the reused sheets S of which the number of reuse is three is accommodated in a lower side in the sheet feeding cassette 20B, and the bundle of the reused sheets S of which the number of reuse is one is accommodated in an upper side in the sheet feeding cassette 20B. In other words, the sheet feeding unit 20 continuously feeds the reused sheet S of which the number of reuse is the same from the sheet feeding cassette 20B to the conveying unit 22 using the pickup roller 21B. In addition, the sheet feeding unit 20 feeds the reused sheet S from the sheet feeding cassette 20B to the conveying unit 22 in an order from the reused sheet S having the smaller number of reuse, using the pickup roller 21B. In the second embodiment, it is possible to fix the image using the erasable toner at an appropriate temperature even in the case where the number of reuse is not readable as described hereinafter, using the fixing temperature stored in the configuration file 552 and the supply of the reused sheet S by the sheet feeding unit 20. More specifically, in the case where the number of reuse of the sheet is not readable by the sensor 23 (No in ACT 204 in FIG. 8), the fixing temperature that is already stored in the temperature storage area of the RAM 54 is used as the target fixing temperature for controlling the heating temperature of the fixer 29.

Figure 8:
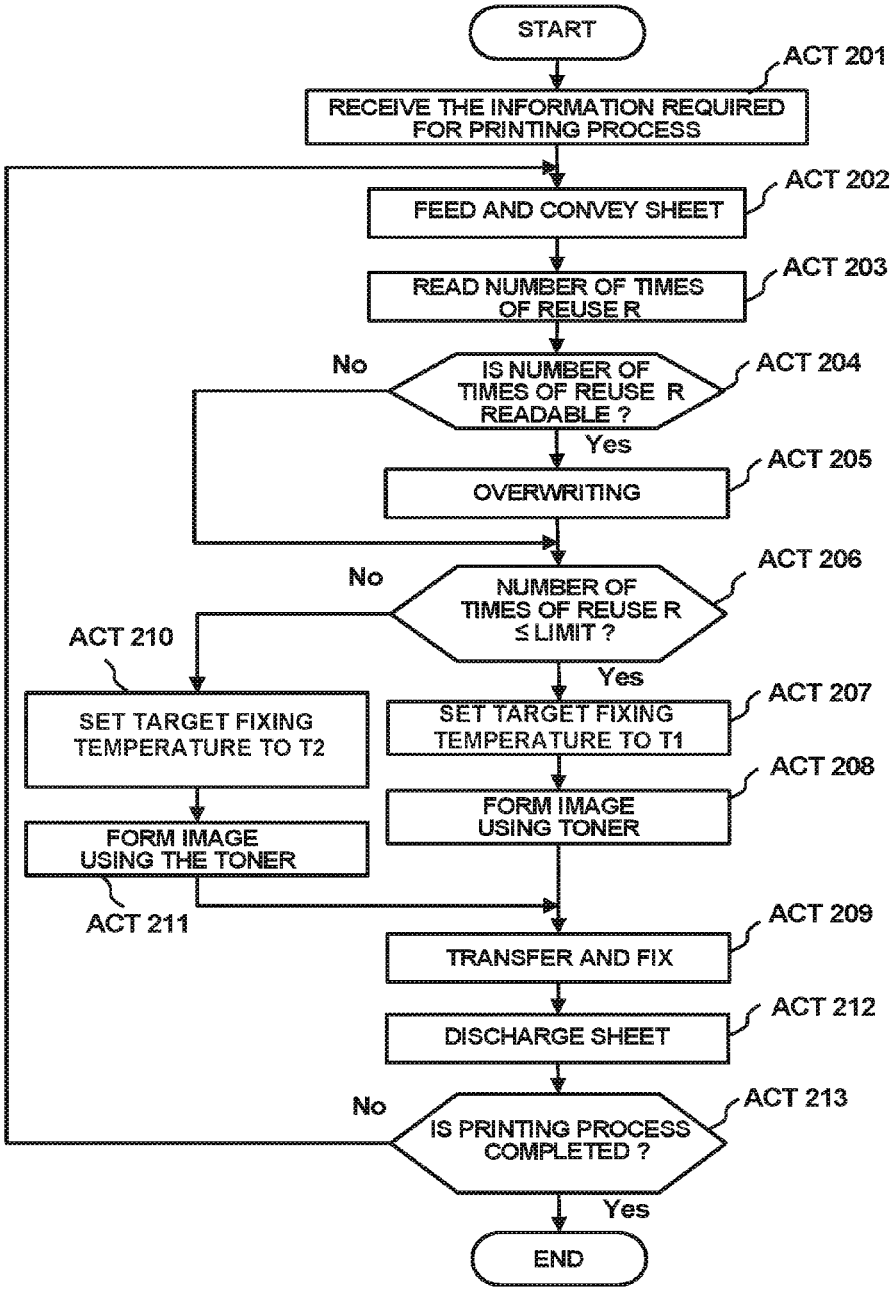
FIG. 8 is a flowchart illustrating a printing process of the image forming apparatus according to the second embodiment.

Similarly to the printing process illustrated in FIG. 7, the printing process illustrated in FIG. 8 is the copy process that prints the document image on the reused sheet S accommodated in the sheet feeding cassette 20B using the erasable toner. As described above, the reused sheet S is the sheet in which the image is printed at least one time using the erasable toner, and further, the image is erased by the image erasing apparatus. Similarly to the first embodiment, the mark X illustrated in FIG. 3 is printed on every reused sheet S accommodated in the sheet feeding cassette 20B. As described above, the mark X is the mark indicating the number of reuse of the sheet.

As illustrated in FIG. 8, in ACT 201, the system controller receives the required information from the user for the printing process and the start instruction of the printing process from the user via the operation panel 4 similarly to the first embodiment (see ACT 101 in FIG. 6). In ACT 201, when the system controller 5 receives the information required for the printing process and the start instruction of the printing process, the operation of the MFP 100 proceeds to ACT 202.

In ACT 202, similarly to the first embodiment, the system controller 5 controls the sheet feeding unit 20 and the conveying unit 22 to convey the reused sheet S to the resist roller 24 (see ACT 102 in FIG. 6). In ACT 202, when the system controller 5 starts the conveyance control of the reused sheet S, the operation of the MFP 100 proceeds to ACT 203.

In ACT 203, similarly to the first embodiment, the system controller 5 controls the sensor 23 to read the mark X (see FIG. 3) printed on the reused sheet S which is being conveyed (see ACT 103 in FIG. 6). In ACT 203, when the system controller 5 reads the mark X (the number of reuse) using the sensor 23, the operation of the MFP 100 proceeds to ACT 204. In ACT 204 (whether or not the number of reuse is readable), the system controller 5 determines whether or not the mark X (the number of reuse) is readable from the reused sheet S.

When the system controller 5 determines that the mark X (the number of reuse) is not readable from the reused sheet S, the system controller 5 reads the number of reuse that is already stored in the number-of-reuse storage area of the RAM 54, and uses the read number of reuse as a retrieval key in ACT 206 to be described hereinafter. In addition, when the system controller 5 determines that the mark X (the number of reuse) is not readable from the reused sheet S (No in ACT 204), the operation of the MFP 100 proceeds to ACT 206.

On the other hand, in ACT 204, when the system controller 5 determines that the mark X (the number of reuse) is readable from the reused sheet S (Yes in ACT 204), the operation of the MFP 100 proceeds to ACT 205. In ACT 205 (overwriting), the system controller 5 overwrites the read number of reuse indicated by the mark X in the number-of-reuse storage area of the RAM 54. In ACT 205, when the system controller 5 overwrites the number of reuse in the number-of-reuse storage area of the RAM 54, the operation of the MFP 100 proceeds to ACT 206.

In ACT 206, the system controller 5 reads the number of reuse stored in the number-of-reuse storage area of the RAM 54. Similarly to the first embodiment, the read number of reuse is used as a retrieval key for retrieving the configuration file of the HDD 55. Accordingly, similarly to the first embodiment, the read number of reuse will be referred to as the number of reuse R hereinafter. The system controller 5 retrieves the number-of-reuse range area (see FIG. 7) of the configuration file 552 of the HDD 55 using the number of reuse R as the retrieval key. The system controller 5 determines whether or not the number of reuse R is equal to or smaller than the maximum number of reuse stored in the number-of-reuse range area of the configuration file 552 on the basis of the result of the retrieval. In other words, the system controller 5 determines whether or not the number of reuse of the reused sheet S exceeds the limit by comparing the number of reuse R and the limit number of reuse, similarly to the first embodiment. More specifically, a range of the maximum number of reuse stored in the configuration file 552 illustrated in FIG. 7 is "six to seven". Accordingly, the system controller 5 determines whether or not the number of reuse R is equal to or smaller than seven.

In a case where the system controller 5 determines that the number of reuse R is equal to or smaller than the maximum number of reuse of "7", that is, a case where the system controller 5 determines that the number of reuse R of the sheet does not exceed the limit (Yes in ACT 206), the operation of the MFP 100 proceeds to ACT 207. In ACT 207, the system controller 5 further retrieves the number-of-reuse range area of the configuration file 552 using the number of reuse R as the retrieval key. The system controller 5 reads the fixing temperature corresponding to the number of reuse R from the fixing temperature storage area (see FIG. 7) of the configuration file 552 on the basis of the result of the retrieval. Similarly to the first embodiment, the system controller 5 stores the read fixing temperature in the temperature storage area of the RAM 54. Similarly to the first embodiment, a value of the fixing temperature of the erasable toner stored in the temperature storage area of the RAM 54 will be referred to as the fixing temperature T1. Similarly to the first embodiment, the system controller 5 sets the target fixing temperature for controlling the heating temperature of the fixer 29 as the fixing temperature T1 (see ACT 106 in FIG. 6). In ACT 207, when the system controller 5 sets the target fixing temperature, the operation of the MFP 100 proceeds to ACT 208.

In ACT 208, similarly to the first embodiment, the system controller 5 controls the printer 2 to form the image corresponding to the document image using the erasable toner as the toner image to be transferred to the sheet. In addition, similarly to the first embodiment, the system controller 5 controls the printer 2 to form the image corresponding to the mark X using the non-erasable toner as the toner image to be transferred to the sheet (see ACT 106 in FIG. 6). In ACT 208, when the system controller 5 forms the toner image to be transferred to the sheet by the control of the printer, the operation of the MFP 100 proceeds to ACT 209.

In ACT 209, similarly to the first embodiment, the system controller 5 controls the transfer unit 28 to transfer the erasable toner image corresponding to the document image and the non-erasable toner image corresponding to the mark X from the intermediate transfer belt 27 to the reused sheet S. In addition, similarly to the first embodiment, the system controller 5 controls the fixer 29 to fix the erasable toner image and the image using the non-erasable toner to the reused sheet S at the fixing temperature T1 (see ACT 107 in FIG. 6).

On the other hand, in ACT 206, in a case where the system controller 5 determines that the number of reuse R is larger than the maximum number of reuse of "7", that is, a case where the system controller 5 determines that the number of reuse R of the sheet exceeds the limit (No in ACT 206), the operation of the MFP 100 proceeds to ACT 210. In ACT 210, similarly to the first embodiment, the system controller 5 sets the target fixing temperature for controlling the heating temperature of the fixer 29 as the fixing temperature T2 (see ACT 109 in FIG. 6). In ACT 210, when the system controller 5 sets the target fixing temperature, the operation of the MFP 100 proceeds to ACT 211.

In ACT 211, similarly to the first embodiment, the system controller 5 controls the printer 2 to form the image corresponding to the document image and the image corresponding to the mark X (for example, the letters of "END") using the non-erasable toner as the toner image to be transferred to the sheet (see ACT 110 in FIG. 6). In ACT 211, when the system controller 5 forms the toner image to be transferred to the sheet by the control of the printer, the operation of the MFP 100 proceeds to ACT 209.

In ACT 209, similarly to the first embodiment, the system controller 5 controls the transfer unit to transfer the non-erasable toner image corresponding to the document image and the non-erasable toner image corresponding to the mark X to the reused sheet S from the intermediate transfer belt 27. In addition, the system controller 5 controls the fixer 29 to fix the images using the non-erasable toner to the reused sheet S at the fixing temperature T2 (see ACT 107 in FIG. 6).

In ACT 209, when the fixing process using the fixer 29 is completed, the operation of the MFP 100 proceeds to ACT 212. In ACT 212, similarly to the first embodiment, the system controller 5 controls the conveyance of the sheet to convey the reused sheet S to the discharge unit 30 (see ACT 108 in FIG. 6). In ACT 212, when the sheet is conveyed to the discharge unit 30, the operation of the MFP 100 proceeds to ACT 213.

In ACT 213, similarly to the first embodiment, the system controller 5 determines whether or not the printing process is completed (see ACT 111 in FIG. 6). When the system controller 5 determines that the printing process is not completed (No in ACT 213), the operation of the MFP 100 returns to ACT 202. On the other hand, when the system controller 5 determines that the printing process is completed (Yes in ACT 213), the system controller 5 terminates the printing process job of the MFP 100.

As described above, the MFP 100 according to the second embodiment may control the fixing temperature of the fixer 29 on the basis of the number of reuse of the sheet recorded on the sheet in the case where the document image is printed using the erasable toner. Accordingly, similarly to the first embodiment, the MFP 100 according to the second embodiment may fix the image to the reused sheet S at an appropriate fixing temperature. Therefore, it is possible to provide the image forming apparatus which is power-saving and environmentally friendly, according to the first embodiment.

In the first and second embodiments, although it is configured such that the number of reuse of the sheet (the mark X) is read by the sensor 23 to be provided in the sheet conveying path in the MFP 100, the MFP 100 according to an embodiment is not limited thereto. For example, the sensor 23 includes the operation panel 4. The sensor 23 may obtain the number of reuse of the sheet by detecting the number of reuse of the sheet input by the user using the operation panel 4.

In the above-described embodiments, the information regarding the reuse of the sheet is the number of times of reuse of the sheet, that is, the number of times that the image is printed to the sheet using the erasable toner so as to allow the printed sheet to be reusable. However, the information regarding the reuse of the sheet is not limited to the number of reuse of the sheet. For example, the information regarding the reuse of the sheet may be the number of times that the image of the sheet is erased by the image erasing apparatus. In addition, the information regarding the reuse of the sheet may be information to be obtained by guessing the number of reuse of the sheet from light reflected from the sheet.

In the embodiments, although the example in which the image is decolorized by heating is described as an image erasing process, the image erasing process is not limited thereto. For example, the image erasing process may be a process of decolorizing an image on a sheet by irradiation of light. The image erasing process of the embodiment may be a process of causing an image on a sheet to be invisible so as to allow the printed sheet to be reusable. In other words, the embodiment may be employed in any image forming apparatus in which a fixing temperature for printing decreases corresponding to the number of reuse of a sheet in a case where an image is printed on the sheet reused by an image erasing process.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a conveying unit configured to convey a sheet;

an image forming unit configured to form an image on the sheet to be conveyed by the conveying unit using an erasable toner;

a fixer configured to heat the image at a target fixing temperature to fix the image to be formed by the image forming unit onto the sheet;

a sensor configured to obtain information printed on the sheet regarding reuse of the sheet including a number of times that the sheet has been subject to an erasing processing for reuse;

a storage unit that stores a plurality of different fixing temperatures, each corresponding to a different number of times that a sheet has been subject to the erasing processing; and a controller configured to:

receive, from the storage unit, the fixing temperature that corresponds to the number of times that the sheet has been subject to the erasing processing for reuse obtained by the sensor, and control a heating temperature of the fixer such that the target fixing temperature is the received fixing temperature, wherein the stored fixing temperatures are lower as the corresponding number of times that a sheet has been subject to the erasing processing is larger.

2. An image forming apparatus comprising:

a conveying unit configured to convey a sheet;

an image forming unit configured to:

form an image on the sheet to be conveyed by the conveying unit using an erasable toner, and form an image on the sheet to be conveyed by the conveying unit using a non-erasable toner;

a fixer configured to heat the image at a target fixing temperature to fix the image to be formed by the image forming unit onto the sheet;

a sensor configured to obtain information printed on the sheet regarding reuse of the sheet including a number of times that the sheet has been subject to an erasing processing for reuse;

a storage unit that stores a plurality of different fixing temperatures each in correspondence with a different number of times that a sheet has been subject to the erasing processing;

a controller configured to:

receive, from the storage unit, the fixing temperature that corresponds to the number of times that the sheet has been subject to the erasing processing for reuse obtained by the sensor, and control a heating temperature of the fixer such that the target fixing temperature is the received fixing temperature; and an operation panel configured to receive a request for an image formation process using the erasable toner, wherein the image forming unit forms an image corresponding to a document image to be subjected to image formation using the erasable toner and an image corresponding to the number of times that the sheet has been subject to the erasing processing using the non-erasable toner in a case where the operation panel receives the request for the image formation process using the erasable toner.

3. The image forming apparatus according to claim 2, wherein the image forming unit forms the image corresponding to the document image to be subjected to image formation using the non-erasable toner in a case where the operation panel receives the request for the image formation process using the erasable toner and the controller determines that the number of times that the sheet has been subject to the erasing processing is larger than a predetermined maximum number of times.

4. The image forming apparatus according to claim 2, wherein the image forming unit forms an image indicating that the number of times of reuse is larger than a predeterimined maximum number of times of reuse using the non-erasable toner instead of the image corresponding to the number of times that the sheet has been subject to the erasing processing in a case where the controller determines that the number of times that the sheet has been subject to the erasing processing is larger than the maximum number of times.

5. The image forming apparatus according to claim 2, wherein the plurality of different fixing temperatures are each stored in the storage unit in correspondence with a range of the different number of times that a sheet has been subject to the erasing processing.

6. The image forming apparatus according to claim 2, wherein the controller sets the fixing temperature most recently used for the erasing processing as the target fixing temperature in a case where it is determined that the number of times of reuse is not readable by the sensor.

* * * * *